US005909766A

United States Patent [19]

Kobayashi et al.

[11] Patent Number: 5,909,766

[45] Date of Patent: Jun. 8, 1999

[54] HEAT EXCHANGER HAVING A STRUCTURE FOR DETECTING FLUID LEAKAGE

[75] Inventors: Osamu Kobayashi, Kariya; Ken Yamamoto, Obu, both of Japan

[73] Assignee: Denso Corporation, Kariya, Japan

[21] Appl. No.: 09/107,151

[22] Filed: Jun. 29, 1998

[51] Int. Cl.[6] ..... F28F 11/00

[52] U.S. Cl. ..... 165/70; 165/153

[58] Field of Search ..... 165/70, 153

[56] References Cited

U.S. PATENT DOCUMENTS

| | | | |
|---|---|---|---|
| 3,099,520 | 7/1963 | Hallstrom | 165/70 X |
| 3,469,623 | 9/1969 | Rawlings | 165/70 |
| 4,228,848 | 10/1980 | Wadkinson, Jr. | 165/70 X |
| 4,635,711 | 1/1987 | Clark, Jr. | 165/70 |
| 4,903,758 | 2/1990 | Cowan | 165/70 X |

FOREIGN PATENT DOCUMENTS 120087 7/1983 Japan .

*Primary Examiner*—Leonard Leo

*Attorney, Agent, or Firm*—Harness, Dickey & Pierce, PLC

[57] ABSTRACT

A heat exchanger has a plurality of tubes and tank portions formed by a plurality of first thin plates laminated and connected to each other, and a plurality of covering members formed by a plurality of second thin plates laminated and connected to each other. The covering members cover the tubes and the tank portions while forming a plurality of openings therebetween. Each of the first thin plates has a communication hole so that each of the openings communicates with each other. An electromagnetic valve is disposed in the heat exchanger to control a communication between the opening and an outer space of the heat exchanger. Thus, when any one of the tubes and the tank portions cracks and leaks refrigerant flowing therethrough, refrigerant is collected into the openings and is accurately rapidly discharged to the outer space by an opening operation of the electromagnetic valve.

9 Claims, 4 Drawing Sheets

HEAT EXCHANGER HAVING A STRUCTURE FOR DETECTING FLUID LEAKAGE

CROSS-REFERENCE TO RELATED APPLICATION

This application relates to and claims priority from Japanese Patent Application No. Hei. 9-179902 filed on Jul. 4, 1997, the contents of which are hereby incorporated by reference.

BACKGROUND OF THE INVENTION

1. Field of the Invention

The present invention relates to a heat exchanger for a refrigerant cycle in which flammable fluid (i.e., flammable gas) such as propane or butane circulates as refrigerant.

2. Description of Related Art

An evaporator is one of heat exchangers disposed in a refrigerant cycle in which chlorofluorocarbon (hereinafter referred to as "flon") circulates as refrigerant. The evaporator has a plurality of tubes and tank portions which are formed by laminating and connecting a plurality of thin plates molded into predetermined shapes.

Recently, a refrigerant cycle in which flammable fluid such as propane or butane is used as refrigerant instead of flon has been widely studied. In such a refrigerant cycle, it is desired to use a heat exchanger which can prevent leakage of refrigerant (i.e, fluid) from the heat exchanger.

JP-A-58-120087 discloses a heat exchanger having a double-cylinder structure for detecting fluid leakage. However, the heat exchanger is designed for a hot-water supply system, and has a simple double-cylinder structure. That is, the heat exchanger is different from a laminated-type heat exchanger which is formed by laminating and connecting a plurality of thin plates. Therefore, the double-cylinder structure can not be directly applied to the laminated-type heat exchanger.

SUMMARY OF THE INVENTION

In view of the foregoing problems, it is an object of the present invention to provide a heat exchanger having a plurality of tubes and tank portions formed by a plurality of thin plates laminated and connected to each other. In the heat exchanger, fluid (e.g., refrigerant) leaking from the tubes or the tank portions is readily accurately discharged to an outer space when any one of the tubes and the tank portions of the heat exchanger cracks and leaks the fluid.

According to the present invention, a heat exchanger includes a plurality of tubes through which a first fluid flows, a plurality of tank portions for distributing the first fluid to the tubes and collecting the first fluid from the tubes, and a plurality of covering members which cover the tubes and the tank portions to form a plurality of openings between the covering members, and the tubes and the tank portions. The tubes and the tank portions are formed by a plurality of first plates laminated and connected to each other, and the covering members are formed by a plurality of second plates which are laminated in accordance with the lamination of the first plates to form the opening separated the first plates. Each of the first plates has a communication hole through which the openings separated by the first plates communicates with each other. Thus, the opening formed outside the tubes and the tank portions communicate with each other through the communication holes.

Further, the heat exchanger has a valve member for switching a communication between the openings and an outer space, and a pressure detecting unit for detecting a pressure inside the openings. When it is determined that the pressure inside the openings becomes out of a preset pressure range by the pressure detecting unit, the valve member is controlled to be opened. Thus, when any one of the tubes and the tank portions cracks, refrigerant leaking from the tubes or the tank portions is collected into the openings, and is rapidly accurately discharged to the outer space of the heat exchanger.

Preferably, the openings are sealed with a second fluid having a pressure higher than an atmospheric pressure and lower than a pressure of the first fluid. Therefore, according to the pressure detected by the pressure detecting unit, it can be readily determined that a leakage of the first fluid is caused within the tubes and the tank portions or a leakage of the second fluid is caused. That is, when the pressure detected by the pressure detecting unit is more than the preset pressure range, it can be determined that the first fluid leaks. On the other hand, when the pressure detected by the pressure detecting unit is less than the preset pressure range, it can be determined that the second fluid leaks.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PREFERRED EMBODIMENT

A preferred embodiment of the present invention will be described hereinafter with reference to the accompanying drawings.

Figure 1:
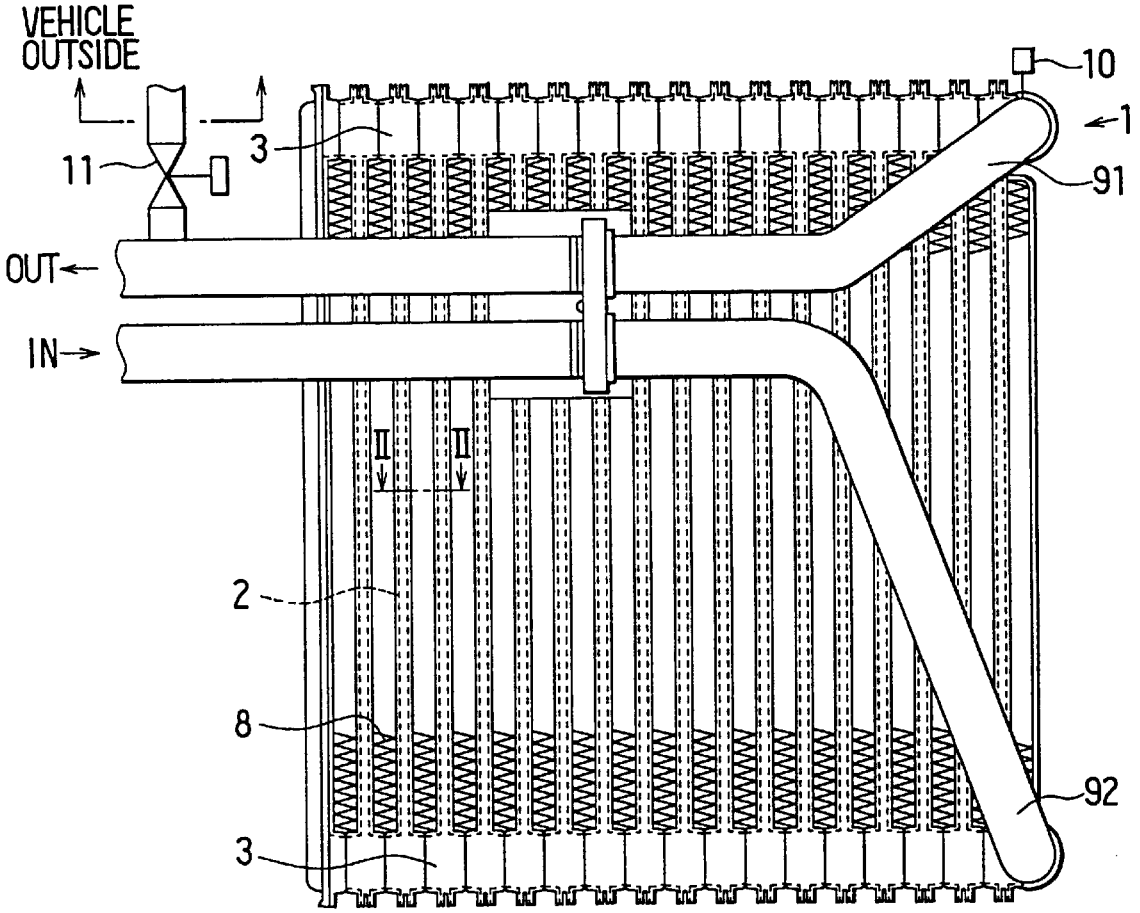
FIG. 1 is a front view of an evaporator according to a preferred embodiment of the present invention.
Figure 4:
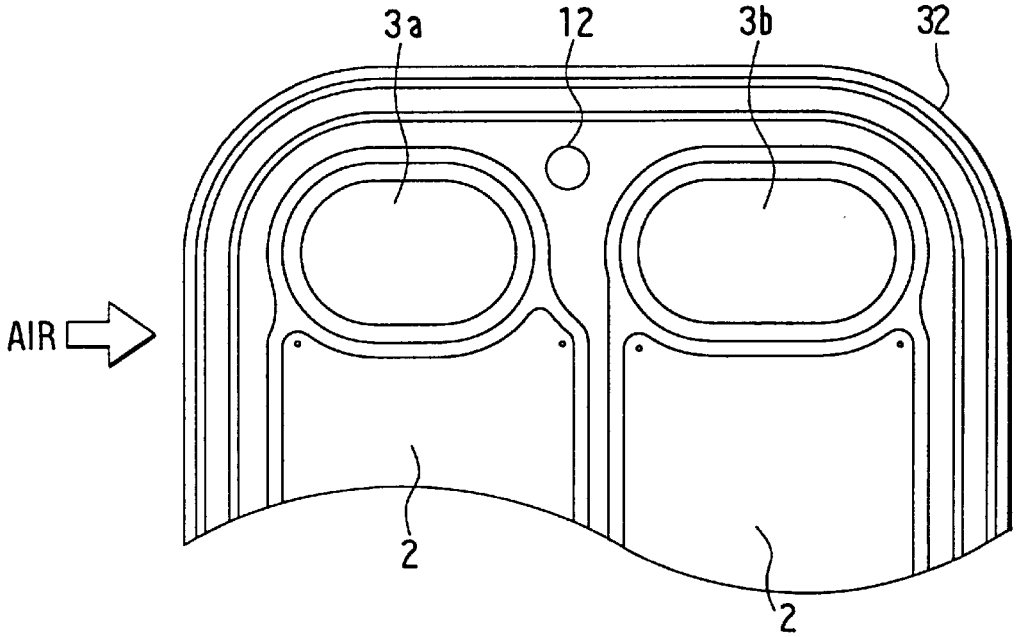
FIG. 4 is a cross-sectional view taken along line IV—IV in FIG. 3, showing a first thin plate of the evaporator according to the embodiment.
Figure 5:
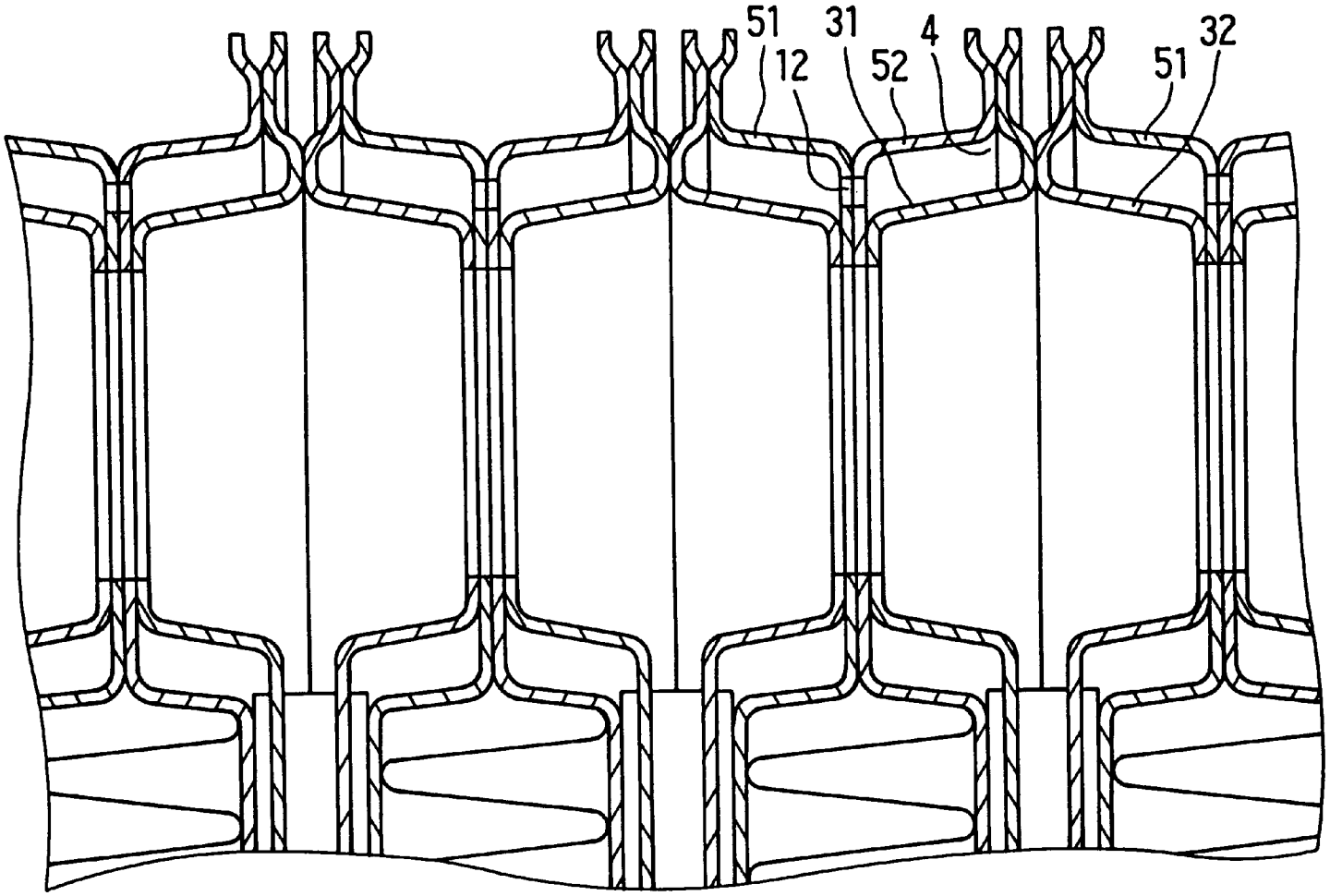
FIG. 5 is a partial horizontal cross-sectional view similar to FIG. 3 but according to another embodiment of the present invention.

In the embodiment, a heat exchanger of the present invention is applied to an evaporator 1 for an air conditioning apparatus for a vehicle. In FIG. 1, air flows in a front-back direction of the paper. The evaporator 1 has a plurality of tubes 2 through which refrigerant (i.e., fluid) flows, and a tank portion 3 connected to each tube 2 at two ends of each tube 2. The tank portions 3 has a distribution tank portion 3*a* and a collection tank portion 3*b*, as shown in FIG. 4. Each of tubes 2 communicates with the distribution tank portion 3*a* and the collection tank portion 3*b* so that refrigerant in the distribution tank portion 3*a* is distributed to each of the tubes 2 and refrigerant flowing from each of the tubes 2 is collected into the collection tank portion 3*b*.

Figure 2:
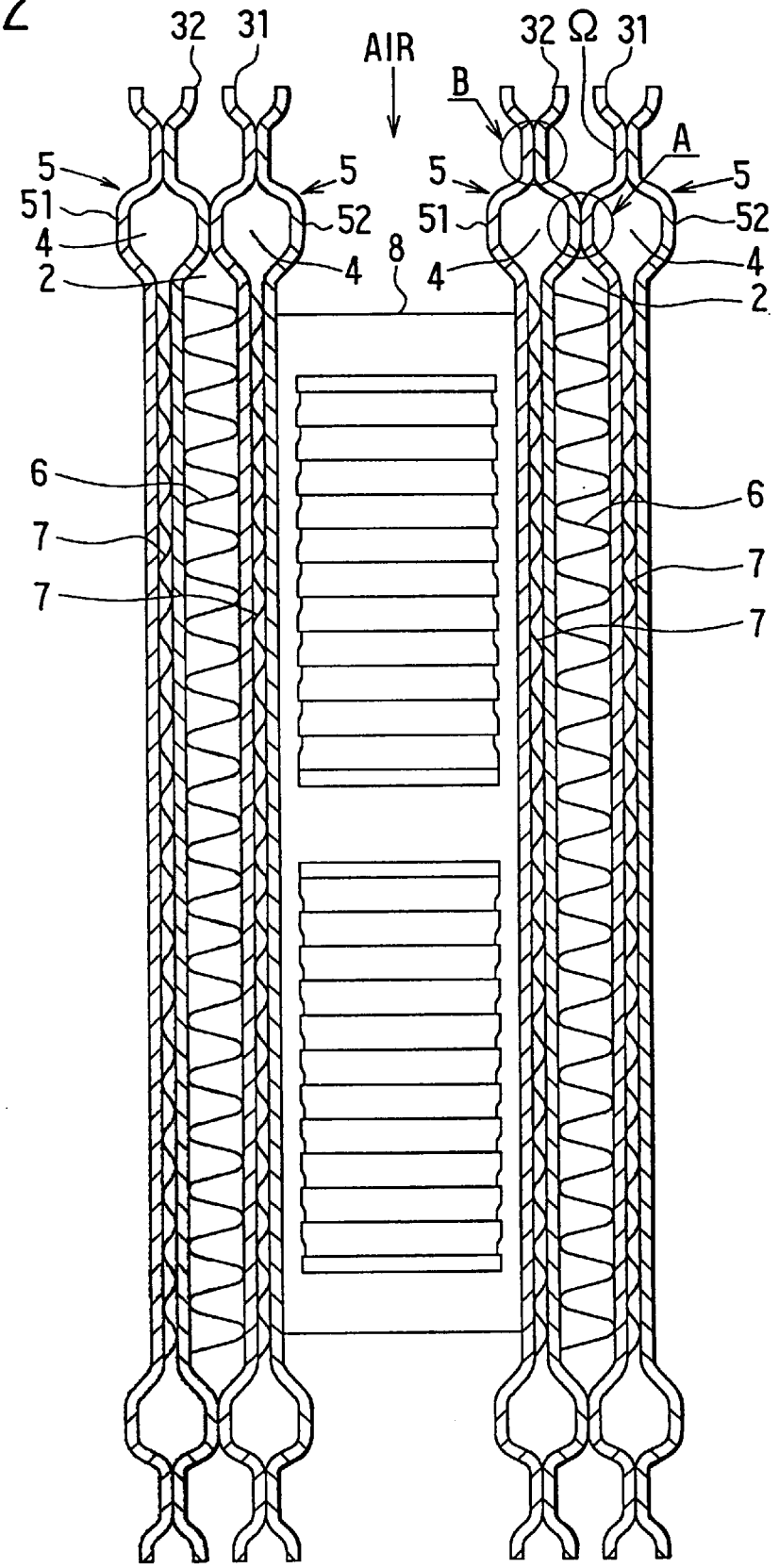
FIG. 2 is a vertical cross-sectional view taken along line II—II in FIG. 1.
Figure 3:
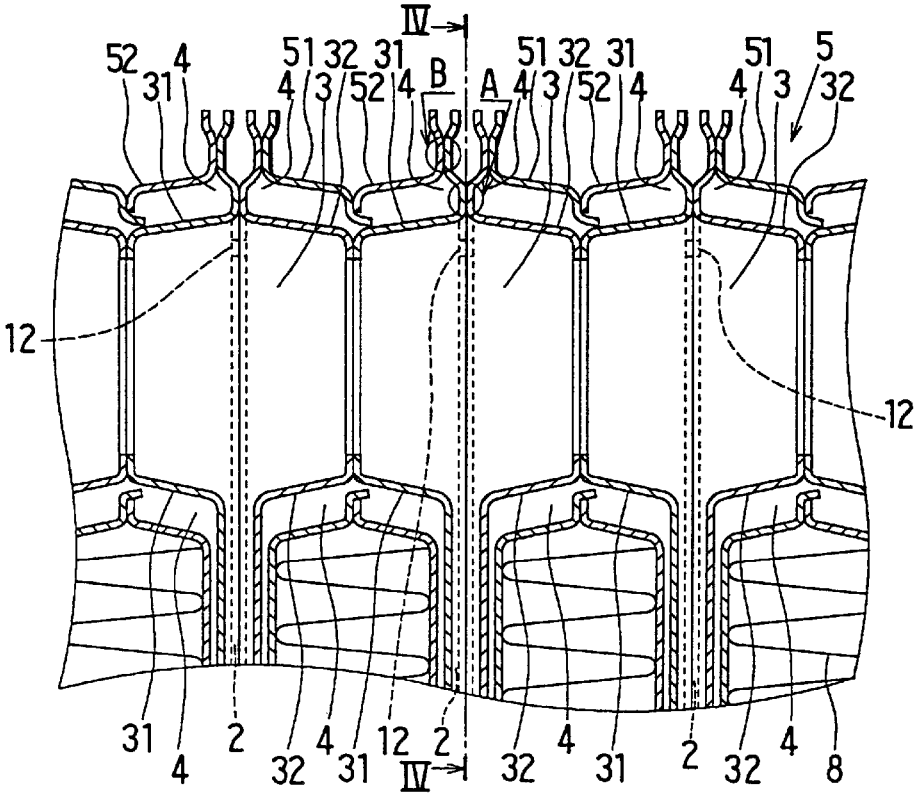
FIG. 3 is a partial horizontal cross-sectional view in FIG. 1, when viewed from an air flow direction.

As shown in FIGS. 2, 3, the tubes 2 and the tank portions 3 are formed by connecting first thin plates 31, 32 as a pair and by laminating a plurality of the pairs of the first thin plates 31, 32. Each of the first thin plates 31, 32 is made of aluminum, and is press-formed into a predetermined shape. In FIG. 3, air flows in a front-back direction of the paper. A pair of the first thin plates 31, 32 forming the tube 2 and the tank portion 3 are covered by a pair of second thin plates 51, 52 forming a covering member 5 so that a predetermined opening 4 is formed between the first thin plates 31, 32 and the second thin plates 51, 52. Each of the second thin plates 51, 52 has a predetermined shape. The second thin plates 51, 52 are laminated in accordance with the laminating structure of the first thin plates 31, 32 to cover the first thin plates 31, 32 and to be connected to the first thin plates 31, 32.

Each of the first thin plates 31, 32 has a communication hole 12 disposed between the distribution tank portion 3*a* and the collection tank portion 3*b*. Therefore, each adjacent openings 4 separated by the first thin plates 31, 32 communicates with each other through the communication holes 12.

Further, as shown in FIG. 2, since each of the tubes 2 has therein an inner fin 6, a refrigerant contact-area is increased within the tube 2, and heat-exchanging performance of the evaporator 1 can be improved. Heat-conduction fins 7 are formed in each of the openings 4 to facilitate heat conduction from the first thin plates 31, 32 (i.e., tube 2 and tank portion 3) to the second thin plates 51, 52 (i.e., covering member 5). Furthermore, a plurality of corrugated fins 8 directly contacting air are attached between each adjacent tubes 2 to facilitate heat exchange between refrigerant flowing through the tubes 2 and air passing through the corrugating fins of the evaporator 1.

Referring to FIG. 2, the first thin plates 31, 32 are connected with each other by a connection portions A, and the second thin plate 51 is connected with each of the first thin plate 32 by a connection portion B, for example. Each of the connection length of the connection portions A, B is more than a thickness of the first and second thin plates 31, 32, 51, 52 at the connection portions A, B. In the embodiment, the thickness of the first and second thin plates 31, 32, 51, 52 is 0.45 mm and each connection length of the connection portions A, B is 3.0 mm. When the thickness of the first thin plates 31, 32 is different from the thickness of the second thin plates 51, 52, it is necessary that the connection length of the connection portions A, B is determined based on the larger thickness of the thin plates. Preferably, each of the connection length of the connection portions A, B is more than five times of the larger thickness of the thin plates. Each of the first and second thin plates 31, 32, 51, 52 are made of an aluminum, and is clad with brazing material on both sides of each plate. The first and second thin plates 31, 32, 51, 52 are integrally brazed together in a furnace using the brazing material.

Referring to FIG. 1, the evaporator 1 is connected to an outlet connection pipe 91 through which refrigerant having been heat-exchanged in the evaporator 1 is discharged and an inlet connection pipe 92 through which refrigerant is introduced into the evaporator 1. Each of the outlet and inlet connection pipes 91, 92 has a double-cylinder structure consisting of an inner cylinder (not shown) communicating with the tank portions 3 and the tubes 2, and an outer cylinder communicating with the openings 4. The outer cylinder communicates with an outside space outside a passenger compartment of a vehicle. In the outer cylinder of the outlet connection pipe 91, a pressure sensor 10 for detecting a pressure inside the openings 4 is disposed at an outlet side of the evaporator 1, and an electromagnetic valve 11 for controlling the communication between the outside space and the outer cylinder is disposed at a downstream side of the pressure sensor 10. An output signal sent from the pressure sensor 10 is input to a control unit (not shown), and the control unit controls an opening degree of the electromagnetic valve 11 according to the output signal from the pressure sensor 10.

Further, the openings 4 are sealed with fluid at a pressure higher than an atmospheric pressure and lower than a pressure of refrigerant flowing through the tubes 2 and the tank portions 3. For example, in the embodiment, the openings 4 are sealed with nitrogen at the pressure of 1.5 $kgf/cm^2$. When the pressure inside the openings 4 becomes out of a preset pressure range, the control unit opens the electromagnetic valve 11 so that the openings 4 communicates with the outside space of the passenger compartment, and warns a passenger in the passenger compartment using warning means such as a buzzer or a lamp. The pressure inside the openings 4 may fluctuate within the preset pressure range by variation in temperature of fluid inside the openings 4. Therefore, by the preset pressure range, the electromagnetic valve 11 is prevented from being opened due to the variation in temperature of fluid inside the openings 4.

According to the embodiment, each of the first thin plates 31, 32 has the communication hole 12 for communicating between each openings 4 separated by the first thin plates 31, 32. That is, each of the openings 4 formed outside the tubes 2 and tank portions 3 communicates with each other through the communication holes 12 to form a single communication space.

Therefore, even when any one of the tubes 2 and the tank portions 3 cracks and leaks refrigerant flowing therethrough, refrigerant flows into the openings 4 and is discharged toward the outside of the passenger compartment accurately. Further, even if fluid sealed inside each of the openings 4 expands when the first and second thin plates 31, 32, 51, 52 are brazed in a furnace, the expanded fluid in each of the openings 4 can be released from an attachment hole for attaching the electromagnetic valve 11 because each of the openings 4 communicates with each other to form the single communication space. Therefore, brazing failure of the first and second thin plates 31, 32, 51, 52 can be prevented, and the first and second thin plates 31, 32, 51, 52 are accurately brazed integrally.

When the pressure inside the openings 4 becomes out of the above-described preset pressure range, it can be determined that a crack is caused in at least one of the first thin plates 31, 32 and the second thin plates 51, 52. That is, when the pressure inside the openings 4 becomes larger than the preset pressure range, it can be determined that a crack is caused in any one of the first thin plates 31, 32. When the pressure inside the openings 4 becomes less than the preset pressure range, it can be determined that a crack is caused in any one of the second thin plates 51, 52.

According to the embodiment, when the pressure inside the openings 4 becomes out of the preset pressure range, the electromagnetic valve 11 is opened. Therefore, even if any one of the first thin plates 31, 32 cracks and leaks refrigerant, refrigerant is discharged to the outside of the passenger compartment promptly. Further, when any one of the second thin plates 51, 52 cracks, a passenger in the passenger compartment is informed by a warning that a problem occurs in the evaporator 1.

The capacity of the openings 4 is sufficiently large as compared with that of a crack caused in the second thin plates 51, 52. Therefore, even when both of the first thin plates 31, 32 and the second thin plates 51, 52 crack, almost all amount of refrigerant leaking from a crack in the first thin plates 31, 32 is discharged toward the outside space of the passenger compartment. Thus, the openings 4 is not only used to detect any crack in the first thin plates 31, 32 (including the connection portions A, B) in addition to the pressure sensor 10, but also is used to discharge leaking-refrigerant to the outside of the passenger compartment. That is, in the embodiment, the openings 4 is used as a leakage detection passage.

Further, according to the embodiment, each of the connection length of the connection portions A, B is longer than the thickness of the first and second thin plates 31, 32, 51, 52 at the connection portions A, B. Therefore, the connection portions A, B are not likely to crack before any of the first and second thin plates 31, 32, 51, 52 cracks due to corrosion or fatigue. This prevents refrigerant from leaking from the connection portions A, B.

Although the present invention has been fully described in connection with the preferred embodiment thereof with reference to the accompanying drawings, it is to be noted that various changes and modifications will become apparent to those skilled in the art.

For example, in the above-described embodiment, the electromagnetic valve 11 and the pressure sensor 10 are used to control a communication between the openings 4 and the outside space of the passenger compartment; however, a relief valve may be used to control the communication between the openings 4 and the outside space of the passenger compartment. It is difficult for a relief valve to determine whether or not a crack is caused in any of the second thin plates 51, 52 crack, because the relief valve generally opens when the pressure becomes larger than a preset value. However, if both the first thin plates 31, 32 and the second thin plates 51, 52 crack, the relief valve is opened so that leaking-refrigerant can be discharged toward the outside of the passenger compartment. Therefore, the relief valve can be employed instead of the pressure sensor 10 and the electromagnetic valve 11.

In the above-described embodiment, a crack caused in any of the first and second thin plates 31, 32, 51, 52 is determined according to the pressure variation inside the openings 4. However, the crack caused in any of the first and second thin plates 31, 32, 51, 52 may be determined according to a density of fluid sealed into the openings 4 (e.g., nitrogen) or a density of refrigerant leaking from the first plates 31, 32, detected by a sensor.

Further, in the above-described embodiment, the single electromagnetic valve 11 is used; however, a plurality of the electromagnetic valves 11 may be used.

Furthermore, in the above-described embodiment, the heat exchanger according to the present invention is applied to an evaporator for an air conditioning apparatus for a vehicle; however, the heat exchanger of the present invention may be applied to an evaporator for an air conditioning apparatus for household use or the like.

In the above-described embodiment, the communication holes 12 are formed on the first thin plates 31, 32 because the openings 4 are separated by the first thin plates 31, 32. However, if the openings 4 are separated by the second thin plates 51, 52, the communication holes 12 may be formed on the second thin plates 51, 52. In the above-described embodiment, each of the outlet and inlet connection pipes 91, 92 has the double-cylinder structure; however, only the outlet connection pipe 91 may be formed in a double-cylinder structure.

Such changes and modifications are to be understood as being within the scope of the present invention as defined by the appended claims.

What is claimed is:

1. A heat exchanger comprising:

a plurality of tubes through which a first fluid flows;

a plurality of tank portions connected at both ends of each tube, for distributing said first fluid to said tubes and for collecting said first fluid from said tubes; and a plurality of covering members which cover said tubes and said tank portions to form a plurality of openings between said covering members, said tubes and said tank portions, wherein:

said tubes and said tank portions are formed by a plurality of first plates laminated and connected to each other;

said covering members are formed by a plurality of second plates which are laminated in accordance with the lamination of said first plates to form said openings separated by said first plates; and each of said first plates has a communication hole through which said openings separated by said first plates communicates with each other.

2. The heat exchanger according to claim 1, further comprising a valve member for switching a communication between said openings and an outer space of the heat exchanger.

3. The heat exchanger according to claim 2, wherein:

said openings are sealed with a second fluid in a preset pressure range; and said valve member is opened in such a manner that said openings communicate with said outer space, when a pressure of said second fluid inside said openings becomes out of the preset pressure range.

4. The heat exchanger according to claim 3, wherein:

said second fluid inside said openings has a pressure higher than an atmospheric pressure and lower than a pressure of said first fluid.

5. The heat exchanger according to claim 4, further comprising:

a pressure detecting unit for detecting a pressure of said second fluid in said opening, wherein an opening degree of said valve member is controlled in accordance with the pressure of said second fluid, detected by said pressure detecting unit.

6. The heat exchanger according to claim 1, wherein:

said first plates are connected at first connection portions to form said tubes and said tank portions; and each length of said first connection portions is more than five times of a thickness of said first plates.

7. The heat exchanger according to claim 6, wherein:

said first plates and said second plates are connected at second connection portions to form said openings; and each length of said second connection portions is more than five times of a thickness of said first plates and said second plates.

8. The heat exchanger according to claim 7, wherein:

each length of said first connection portions and said second connection portions is 3.0 mm and the thickness of said first and second plates is 0.45 mm.

9. A heat exchanger comprising:

a plurality of tubes through which a first fluid flows;

a plurality of tank portions connected at both ends of each tube, for distributing said first fluid to said tubes and for collecting said first fluid from said tubes; and a plurality of covering members for covering said tubes and tank portions to form a plurality of openings between said covering members, said tubes and said tank portions, wherein:

said tubes and said tank portions are formed by a plurality of first plates laminated and connected to each other;

said covering members are formed by a plurality of second plates which are laminated in accordance with the lamination of said first plates to form said openings separated by said second plates; and each of said second plates has a communication hole through which said openings separated by said second plates communicates with each other.

* * * * *

UNITED STATES PATENT AND TRADEMARK OFFICE

CERTIFICATE OF CORRECTION

PATENT NO. : 5,909,766

DATED : June 8, 1999

INVENTOR(S) : Osamu Kobayashi et al

It is certified that error appears in the above-identified patent and that said Letters Patent is hereby corrected as shown below:

Title Page, insert: -- [30] Foreign Application Priority Data

Jul 4, 1997 [JP] Japan ..... 9-179902 --

Signed and Sealed this

Fourteenth Day of March, 2000

*Attest:*

*Attesting Officer*

Q. TODD DICKINSON

*Commissioner of Patents and Trademarks*